United States Patent [19]

Niimura et al.

[11] 4,433,040

[45] Feb. 21, 1984

[54] ELECTROPHOTOGRAPHIC TONER CONTAINING A METAL COMPLEX DYE

[75] Inventors: Isao Niimura; Hiroshi Imagome; Hiroyoshi Yamaga; Noboru Akuzawa, all of Tokyo; Kenji Yuta, Koriyama; Takeo Kurahashi, Tokyo, all of Japan

[73] Assignee: Hodogaya Chemical Company, Ltd., Tokyo, Japan

[21] Appl. No.: 334,904

[22] Filed: Dec. 28, 1981

[30] Foreign Application Priority Data

Feb. 27, 1981 [JP] Japan ..... 56-26768
Jul. 8, 1981 [JP] Japan ..... 56-105641

[51] Int. Cl.[3] ..... G03G 13/09
[52] U.S. Cl. ..... 430/109; 430/110
[58] Field of Search ..... 430/109, 110, 106, 122

[56] References Cited

U.S. PATENT DOCUMENTS 3,165,420 1/1965 Tornanek et al. ..... 430/106
3,915,874 10/1975 Machida ..... 430/106

*Primary Examiner*—John E. Kittle
*Assistant Examiner*—John L. Goodrow
*Attorney, Agent, or Firm*—Austin R. Miller

[57] ABSTRACT

An electrophotographic toner effective for producing clear visible images, comprises a binder resin, and a charge-controlling and coloring agent comprising at least one 2:1 type metal complex of the formula (I):

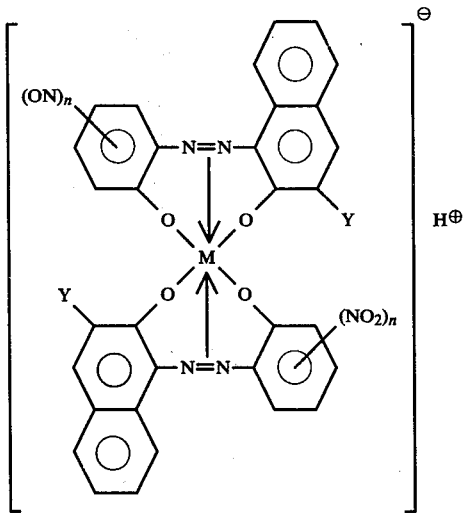

(I)

wherein M is Cr or Co, n is 1 or 2, Y is H or a radical of the formula (II):

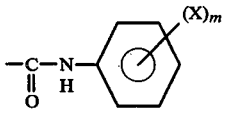

(II)

wherein X is H, a halogen, a lower alkyl, a lower alkoxy or a nitro and m is 1, 2 or 3.

4 Claims, No Drawings

ELECTROPHOTOGRAPHIC TONER CONTAINING A METAL COMPLEX DYE

FIELD OF THE INVENTION

The present invention relates to an electrophotographic toner, particularly, to a toner for developing electrostatic latent images in electrophotography, the toner being capable of being electrified negatively.

BACKGROUND OF THE INVENTION

It is known that in electrophotography and electrostatic printing, electrostatic latent images which are electrified either positively or negatively on a photoconductive layer containing a photoconductive material such as selenium, zinc oxide, cadmium, cadmium sulfide, zinc sulfide, tellurium, anthracene, carbazol compounds or polyvinyl compounds, can be converted into visible images by developing the latent images with a toner. The latent images are produced by imagewisely exposing the surface of the photoconductive layer to actinic rays. The visible images are, if necessary, transferred to a surface of a substrate, such as paper, and, then, fixed thereon by means of heat or a solvent.

The particles of the toner comprise a binder consisting of a natural or synthetic resin and a finely divided coloring agent uniformly dispersed in the binder resin. The coloring agent comprises at least one member selected from dyes and pigments.

The toner is used alone or in combination with a solid carrier comprising finely divided glass or iron particles.

When the latent positive images are electrified negatively and negatively electrified positive images are developed with toner particles electrified positively, the resultant visible images are positive. However, when the latent positive images are electrified positively and the positively electrified positive images are developed with toner particles electrified negatively, the resultant visible images are negative.

Usually, conventional dyes and pigments are capable of being electrified positively. Even if the conventional dyes and pigments are capable of being electrified negatively, the quantity of electricity on the dyes or pigments is unsatisfactory.

Also, some types of dyes and pigments are unsatisfactorily compatible with the binder resin. Therefore, when the latent images electrified positively are developed with the toner particles containing conventional dyes or pigments, the resultant visible images are not clear and, sometimes, foggy.

Also, it is known that some types of metal-containing aromatic compound are effective as a charge-controlling agent. However, conventional metal-containing charge-controlling agents are unsatisfactory as the coloring agent.

For example, U.S. Pat. No. 4,206,064 discloses a negatively electrified toner for developing electrostatic images. The toner contains a charge-controlling agent comprising at least one member selected from metal complexes of salicylic acid and metal complexes of alkyl salicylic acid. However, the above-mentioned types of metal complexes are useless as a coloring agent, and exhibit an unsatisfactory compatibility with the binder resins.

SUMMARY OF THE INVENTION

An object of the present invention is to provide an electrophotographic toner containing a metal complex which is capable of being electrified negatively and is satisfactory not only as a coloring agent, but, also, as a charge-controlling agent.

Another object of the present invention is to provide an electrophotographic toner containing a metal complex which is capable of being electrified negatively and is highly compatible with a binder resin.

The electrophotograpic toner of the present invention, by which the above-mentioned objects can be attained, comprises:

a binder resin;

a charge-controlling and coloring agent comprising at least one 2:1 type metal complex of the formula (I):

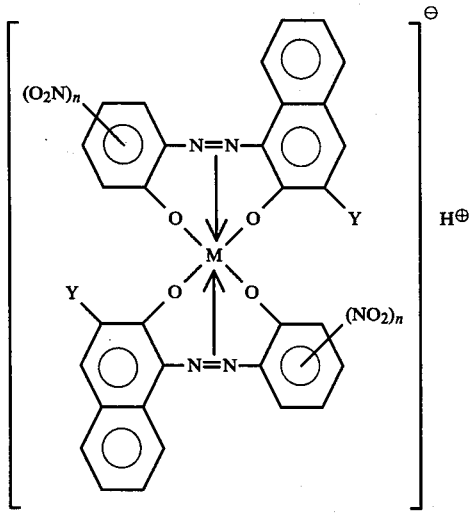

(I)

wherein M represents a member selected from the group consisting of chromium and cobalt atoms, n represents an integer of 1 or 2, and Y represents a member selected from the group consisting of a hydrogen atom and radicals of the formula (II)

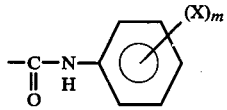

(II)

wherein X represents a member selected from the group consisting of hydrogen and halogen atoms, lower alkyl radicals, lower alkoxy radicals and a nitro radical, and n represents an integer of from 1 to 3.

The above-mentioned metal complex is highly capable of being electrified negatively and exhibits a satisfactory compatibility with the binder resin.

DETAILED DESCRIPTION OF THE INVENTION

The electrophotographic toner of the present invention comprises a binder resin and a specific charge-controlling and coloring agent.

The binder resin may consist of at least one member selected from the group consisting of homopolymers of styrene or substituted styrene such as polystyrene, poly-p-chlorostyrene, polyvinyltoluene and the like, styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylic acid copolymers, styrene-octyl acrylate copolymers, styrene-methyl methacrylate copolymers, styrene-ethyl methacrylate copolymers, styrene-butyl methacrylate copolymers, styrene-methyl-α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, and the like, polyvinyl chloride, polyvinyl acetate, polyethylene, polypropylene, silicone resins, polyesters, polyurethanes, polyamides, epoxy resins, polyvinyl butyral, rosin, modified rosins, terpene resins, phenolic resins, xylene resins, aliphatic or alicyclic hydrocarbon resins, aromatic series petroleum resins, chlorinated paraffins, paraffin waxes and the like.

The charge-controlling and coloring agent usable for the present invention is characterized by comprising at least one specific 2:1 type metal complex dye of the formula (I).

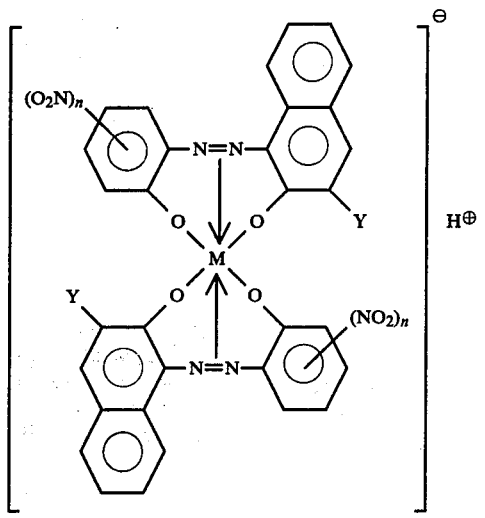

wherein M represents a Cr or Co atom, n denotes an integer of 1 or 2, Y represents a H atom or a radical of the formula (II):

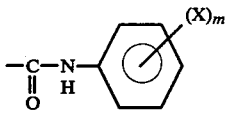

wherein X represents a H atom, a halogen atom, a lower alkyl radical, preferably, having 1 to 4 carbon atoms, a lower alkoxy radical, preferably, having 1 to 4 carbon atoms or a nitro radical, and m represents an integer of 1, 2 or 3.

In the metal complex dyes of the formula (I), it is important that the cationic moiety to be combined with the metal-containing anionic moiety consists of a hydrogen ion (H⊕). It was found by the inventors of the present invention that the cationic moiety consisting of a hydrogen ion is remarkably effective for enhancing the compatibility of the metal complex dye of the formula (I) with the binder resin. Accordingly, the charge-controlling and coloring agent of the present invention can be uniformly dispersed into the binder resin matrix.

It is not completely clear why the metal complex dyes of the formula (I) can exhibit the remarkably high compatibility with the binder resin. However, it is assumed that, since the metal complex dyes of the formula (I) have a very small specific gravity and an enhanced softness, the metal complex dyes are easily divided into very fine particles in the binder resin matrix.

Also, it was found by the inventors of the present invention that the metal complex dyes of the formula (I) exhibit an excellent negative electrification property and can receive a large quantity of electrostatic negative charge.

The metal complex dyes of the formula (I) can be prepared by the following method:

(1) A nitro-substituted 2-aminophenol compound of the formula (III):

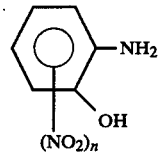

and a β-naphthol compound of the formula (IV):

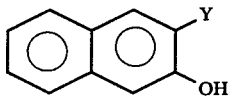

are subjected to a usual coupling procedure to prepare a monoazo compound of the formula (V):

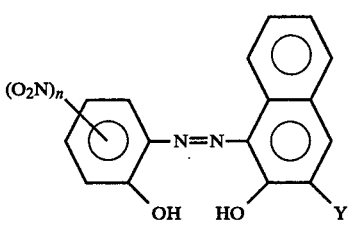

(2) The monoazo compound of the formula (V) is converted into a metal complex of the formula (VI) by a conventional metalization method using a chromium- or cobalt-imparting compound in an organic solvent at an elevated temperature.

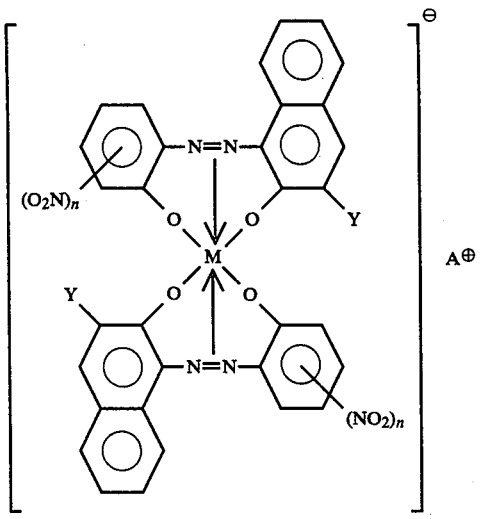

In the formulae (IV), (V) and (VI), M, Y and n are respectively the same as defined hereinbefore, and A⊕ represents an alkali metal cation or an ammonium cation. The metal complex compound of the formula (VI) can be obtained with a high degree of yield.

(3) The metal complex of the formula (VI) is dispersed in a hydrated alcohol, for example, a mixture of 4 parts by weight of water with 6 parts by weight of ethyl alcohol, and a stoichiometrically slightly excessive amount of hydrochloric acid or sulfuric acid is added to the dispersion to change A⊕ to H⊕.

A metal complex of the formula (I) is obtained.

In this stage (3), the alcohol may be selected from lower alcohols, for example, methyl alcohol, ethyl alcohol, propyl alcohol and butyl alcohol. The hydrated alcohol preferably contains 30 to 50% by weight of the alcohol.

In the preparation of the metal complex dyes of the formula (I), the nitro-substituted aminophenol compound of the formula (III) may be selected from 5-nitro-2-aminophenol and 4,6-dinitro-2-aminophenol. The β-naphthol compound of the formula (IV) may be selected from β-naphthol, 3-hydroxy-2-naphthanilide, 3-hydroxy-4'-chloro-2-naphthanilide, 3-hydroxy-2-naphtho-p-anisidide, 3-hydroxy-2-naphtho-o-anisidide, 3-hydroxy-2-naphtho-o-phenetidide, 3-hydroxy-2'-5'-dimethoxy-2-naphthanilide, 3-hydroxy-2-naphtho-o-toluidide, 3-hydroxy-2-naphtho-2',4'-xylidide, 3-hydroxy-3'-nitro-2-naphthanilide, 3-hydroxy-4'-chloro-2-naphtho-o-toluidide, and 3-hydroxy-2',4'-dimethoxy-5'-chloro-2-naphthanilide.

The chromium-imparting compound may be selected from chromic acetate, chromic sulfate and chromium sodium salicylate, and the cobalt-imparting compound may be selected from cobaltic chloride, cobaltous acetate and cobalt sodium salicylate.

The crystals of the metal complex dyes of the formula (I) are extremely dividable. Therefore, the metal complex dyes of the formula (I), obtained from the above-mentioned preparation procedure, can be directly dispersed in the binder resin matrix, without preliminarily pulverizing the metal complex dyes. That is, during the dispersing procedure, the crystals of the metal complex dyes of the formula (I) are easily divided into extremely fine particles and the fine particles are uniformly dispersed in the binder resin matrix.

Also, the finely divided metal complex dyes of the formula (I) exhibit an extremely small bulk density which corresponds to ⅓ to 1/6 of that of conventional dyes. This extremely small bulk density is very effective for enhancing the compatibility of the charge-controlling and coloring agent of the present invention with the binder resin matrix.

It was confirmed that the result of the mutagenity test (Ames test) applied to the metal complex dyes of the formula (I) was negative.

The electrophotographic toner of the present invention can be prepared in the following manner.

A 2:1 type metal complex dye of the formula (I) is mixed with a binder resin in the form of a melt. The amount of the metal complex dye is, preferably, in the range of from 1 to 50% based on the weight of the binder resin. The mixture is cooled to solidify the binder resin. The solidified mixture is converted into fine toner particles by using a pulverizing machine, such as ball mill.

Otherwise, the toner of the present invention can be prepared by the following method.

A binder resin is prepared by mixing the corresponding monomer or monomers with a polymerization initiator and a metal complex dye of the formula (I) and, then, the mixture is subjected to a polymerization procedure in which the mixture is suspended in water.

The most preferable preparation method for the toner of the present invention is the former mixing-solidifying-pulverizing method.

In the preparation of the toner, the mixture to be solidified or to be polymerized, may contain an additional coloring agent, for example, carbon black.

The toner of the present invention is used usually together with a carrier consisting of an iron or glass powder. When the mixture of the toner of the present invention and the carrier is applied to an electrophotographic procedure, friction occurs between the particles of the toner and the particles of the carrier. This friction causes the particles of the toner to be charged with an amount of electrostatic charge, which charge is sufficient for developing electrostatic latent images. Even if the developing operation is repeatedly carried out using the toner, the amount of the electrostatic charge on the toner particles can be maintained constant, and the distribution of the charge on the toner particles can be maintained uniform and constant.

Accordingly, when electrostatic latent images are developed by the toner of the present invention, the resultant visible images have a uniform color dark enough for practically reading and are very bright in comparison with those derived from conventional toners.

SPECIFIC EXAMPLES OF THE INVENTION

The specific examples presented below will serve to more fully elaborate how the present invention is practiced. However, it should be understood that the examples are only illustrative and in no way limit the present invention.

In the examples, the term "part" is always by weight.

EXAMPLE 1 AND COMPARATIVE EXAMPLE 1

In Example 1, a mixture was prepared by agitating 19.9 parts of 4,6-dinitro-2-aminophenol and 26 parts of a concentrated hydrochloric acid together with 400 parts of water. The mixture was cooled with ice to a temperature of 0° C. to 5° C. The cooled mixture was added with 6.9 parts of sodium nitrite. The admixture was agitated at the above-mentioned temperature for 2 hours to diazotize 4,6-dinitro-2-aminophenol. The admixture containing the diazotized compound was added to a mixture of 26.3 parts of 3-hydroxy-2-naphthanilide, 300 parts of water and 10 parts of sodium hydroxide at a temperature of 0° C. to 5° C. to allow the diazotized compound to couple with 3-hydroxy-2-naphthanilide. A monoazo-compound having the following formula was isolated from the reaction mixture.

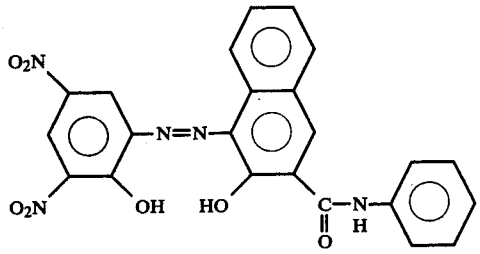

The monoazo compound in the form of a paste was dissolved in 150 parts of ethylene glycol and the resultant solution was mixed with 5 parts of sodium hydroxide and 17.4 parts by weight of chromium sodium salicylate. The mixture was agitated at a temperature of from 110° C. to 120° C. for 2 hours to metallize the monoazo compound with chromium. The mixture was cooled to a temperature of 50° C. and the cooled mixture was added with 10 parts of hydrochloric acid to make the mixture acid when inspected by using Congo Red. The reaction product was isolated from the mixture at room temperature by means of filtration, and finally, dried at a temperature of 50° C. to 60° C. under a reduced pressure.

A chromium complex in the form of a fine black powder was obtained in an amount of 49 parts.

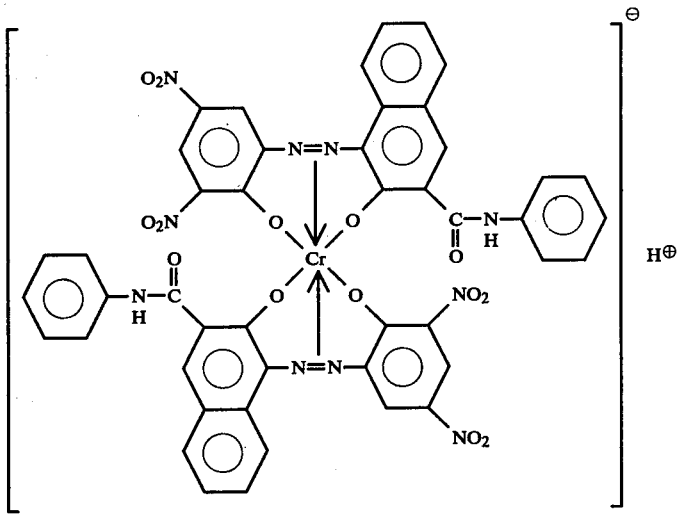

When the chromium complex was dissolved in dimethyl formamide, the solution exhibited a black color having a maximum absorption wave length of 576 nm.

An electrophotographic toner was prepared by using the chromium complex in the following manner.

A uniform mixture of 100 parts of a binder resin consisting of a styrene copolymer, 6 parts of carbon black and 5 parts of the chromium complex was melted at a temperature of 150° C., cooled to solidify the melt and, then, pulverized by using a ball mill. A black toner which is capable of being charged with a negative charge, was obtained. The black toner was mixed with a carrier consisting of fine iron particles having a diameter of 100 to 150 microns, in a weight ratio of 5:100, to prepare an electrophotographic developing agent.

The above-mentioned developing agent was subjected to an electrophotographic procedure as follows.

A predetermined pattern of positive electrostatic latent images was formed on a photosensitive selenium plate surface electrified by means of a corona discharge under a voltage of +5000 V. The latent images were developed with the developing agent by means of a magnetic brush development to form visible positive images. The positive images were transferred onto a piece of paper by means of a corona discharge under a voltage of +5000 V. The transferred images were heat-fixed on the paper by heating it to a temperature of 180° C. The resultant fixed visible images were clear and had no fog.

The above-mentioned electrophotographic procedures were continuously carried out 10,000 times. It was found that no change occurred in the electrification property of the toner. Also, it was found that the average quantity of electricity on the toner was −20 μc/g, which was determined in accordance with the Blow-Off method, and the distribution of the electric charge on the toner was approximately even and was in the range of from −19 μc/g to −21 μc/g.

In Comparative Example 1, the same procedures as those described in Example 1 were carried out, except that in the chromium complex, the paired ion $H^+$ was changed to $NH^+$.

The resultant visible images were soiled around the images and, therefore, were not clear. During the developing procedures, which were repeated 10,000 times, the electrification property of the toner was significantly changed and, therefore, the quality of the resultant visible images was degraded. The average quantity of electricity on the toner was −16 μc/g and the distribution of the electric charge on the toner was uneven and in the range of from −10 to −16 μc/g.

EXMPLE 2

The same procedures as those described in Example 1 were carried out, except that 3-hydroxy-2-naphthanilide was replaced by 14.4 parts of β-naphthol, to produce a chromium complex of the formula:

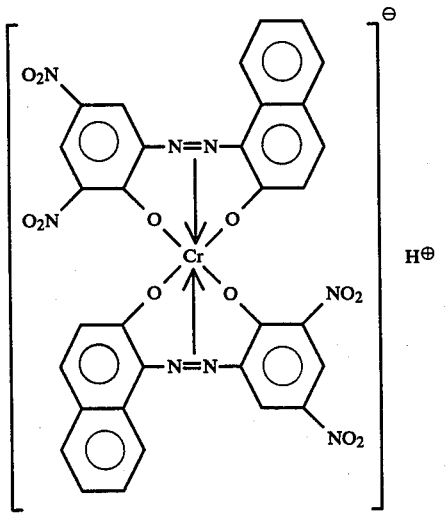

The chromium complex was in the form of fine black particles.

The developing agent containing the above-mentioned chromium complex was effective for forming clear visible images without soiling the visible images on the substrate. Also, it was confirmed that, although the developing procedures were repeated 10,000 times, no change in the electrification property of the toner occurred, and, therefore, the quality of the visible images was constant.

EXAMPLES 3 THROUGH 9

In each of the Examples 3 through 9, the same procedures as those described in Example 1 were carried out, except that the monoazo compound was of the formula:

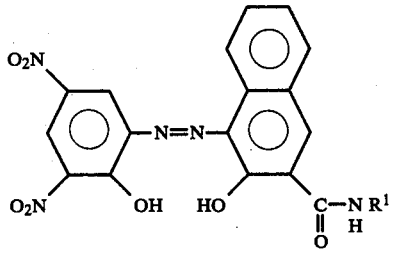

wherein $R^1$ represents a radical of the formula indicated in Table 1; the monoazo compound was dissolved in the solvent indicated in Table 1 and, then, metallized with the metal indicated in Table 1.

The resultant metal complex had the maximum absorption wave length and the color indicated in Table 1.

The developing agent containing the above-mentioned metal complex was effective for forming clear visible images on a paper substrate without soiling around the images. Also, it was confirmed that, although the developing procedures were repeated 10,000 times, no change in electrification property of the toner occurred and the quality of the resultant visible images was constant.

TABLE 1

| Example No. | Type of monoazo compound | Type of metal | Solvent used in metallization procedure | Maximum absorption wave length (nm) | Appearance |
|---|---|---|---|---|---|
| 3 | 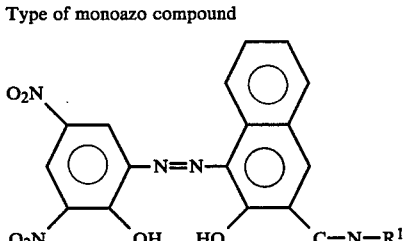 $R^1$: 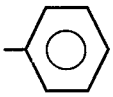 | Co | Water | 575 | Fine black particles |
| 4 | $R^1$: 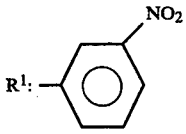 | Cr | Ethylene glycol and water (4:2) | 578 | " |
| 5 | $R^1$: 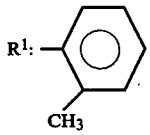 | " | Diethylene glycol | 576 | " |

TABLE 1-continued

| Example No. | Type of monoazo compound | Type of metal | Solvent used in metallization procedure | Maximum absorption wave length (nm) | Appearance |
|---|---|---|---|---|---|
| 6 | 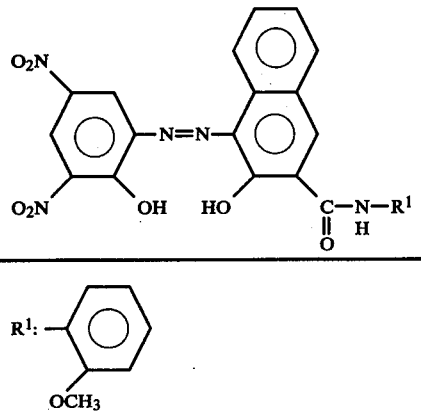 | " | Dimethylformamide | 578 | " |
| 7 | 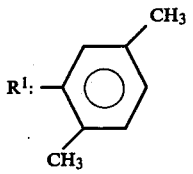 | " | β-oxyethylmethylether | 576 | " |
| 8 | 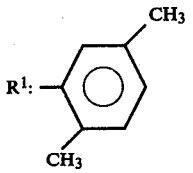 | Co | Formamide | 574 | " |
| 9 | 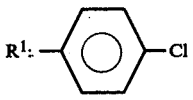 | Cr | Dimethylsulfoxide | 575 | " |

EXAMPLE 10

The same procedures as those described in Example 1 were carried out, except that a monoazo compound of the formula:

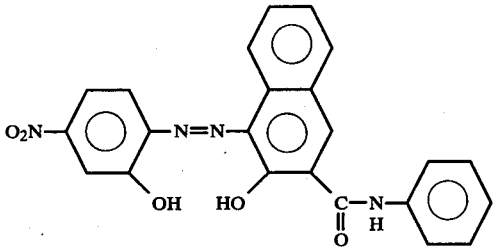

was prepared from 15.4 parts of 5-nitro-2-aminophenol and 26.3 parts of 3-hydroxy-2-naphthanilide and the monoazo compound was metallized with chromium to provide 44 parts of a chromium complex of the formula:

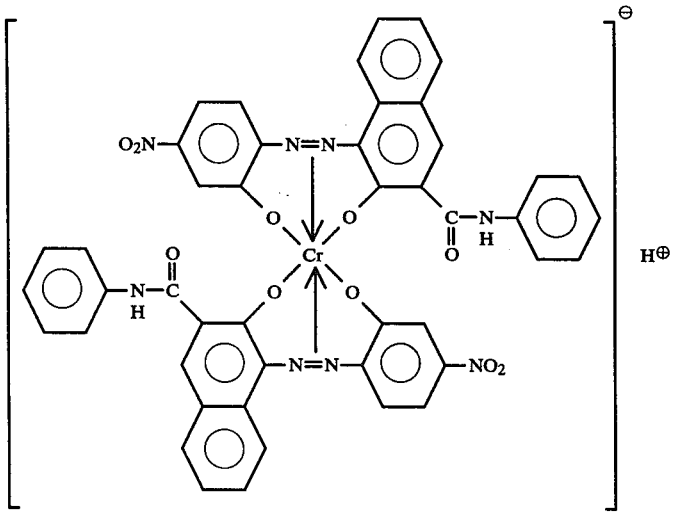

The chromium complex was in the form of fine black particles. A solution of the chromium complex in dimethylformamide exhibited a maximum absorption wave length of 585 nm.

The developing agent containing the above-mentioned chromium complex was useful for producing clear visible images on a substrate consisting of paper without soil being formed around the images. Also, the developing agent could be used for repeating the developing procedures 10,000 times without changing the electrification property of the toner. The quality of the developed visible images was constant during the repeated developing procedures.

EXAMPLES 11 THROUGH 17

In each of the Examples 11 and 17, the same procedures as those described in Example 1 were carried out, except that the monoazo compound was of the formula:

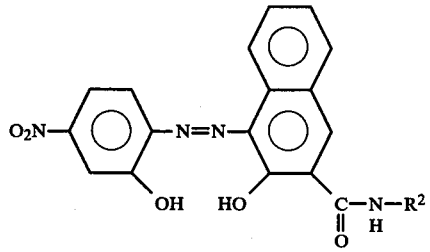

wherein $R^2$ represents the radical indicated in Table 2; the monoazo compound was dissolved in the solvent indicated in Table 2 and, then, metallized with the metal indicated in Table 2.

The resultant metal complex had the maximum absorption wave length and the color indicated in Table 2.

The developing agent containing the above-mentioned metal complex could form clear visible images on a paper substrate without soil being formed around the images. Also, it was confirmed that, although the developing procedures were repeated 10,000 times, the electrification property of the toner was not changed and the quality of the resultant visible images was constant.

TABLE 2

| Example No. | Type of monoazo compound | Type of metal | Solvent used in metallization procedure | Maximum absorption wave length (nm) | Appearance |
|---|---|---|---|---|---|
| 11 | 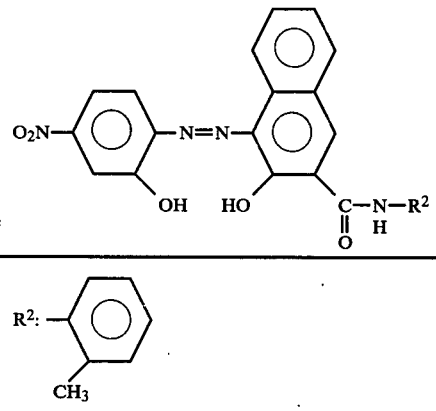 | Cr | Dimethylsulfoxide | 586 | Fine black particles |

TABLE 2-continued

| Example No. | Type of monoazo compound | Type of metal | Solvent used in metallization procedure | Maximum absorption wave length (nm) | Appearance |
|---|---|---|---|---|---|
| 12 | 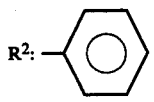 | Co | Water | 575 | " |
| 13 | 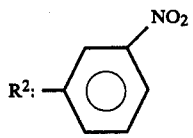 | Cr | β-oxyethylmethylether | 588 | " |
| 14 | 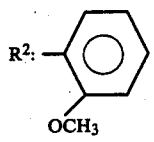 | " | Ethylene glycol | 588 | " |
| 15 | 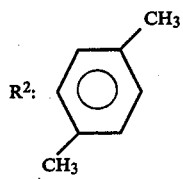 | " | Dimethylformamide and water (5:5) | 586 | " |
| 16 | 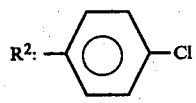 | Co | Diethylene glycol | 573 | " |
| 17 | 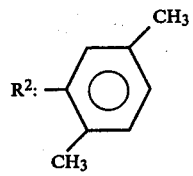 | " | Formamide and water (1:2) | 575 | " |

We claim:

1. An electrophotographic toner capable of being electrified negatively comprising (a) a binder resin; and (b) an agent for coloring said toner and for controlling the negative charge of said toner comprising at least one 2:1 type metal complex of the formula (I):

(I)

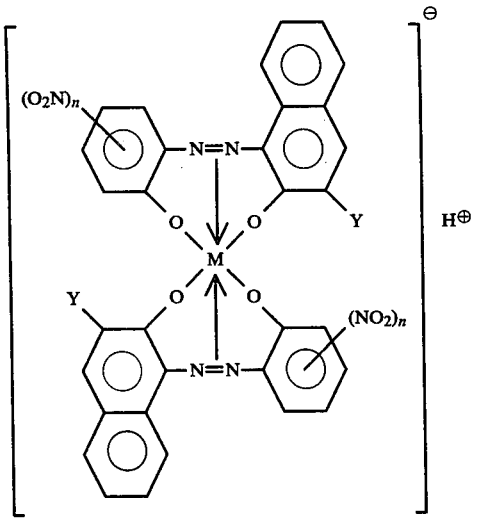

wherein M represents a member selected from the group consisting of chromium and cobalt atoms, n represents an integer of 1 or 2, and Y represents a member selected from radicals of the formula (II):

(II)

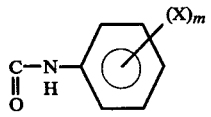

wherein X represents a member selected from the group consisting of hydrogen and halogen atoms, lower alkyl radicals, lower alkoxy radicals and nitro radicals, and m represents an integer of from 1 to 3.

2. A toner as claimed in claim 1, wherein in the formula (II), the lower alkyl radicals represented by X have 1 to 4 carbon atoms.

3. A toner as claimed in claim 1, wherein in the formula (II), the lower alkoxy radicals represented by X have 1 to 4 carbon atoms.

4. A toner as claimed in claim 1, wherein said charge-controlling and coloring agent is present in an amount of 1 to 50% based on the weight of the binder resin.

* * * * *